United States Patent [19]

Kondo

[11] 3,940,030

[45] Feb. 24, 1976

[54] DISPENSER DEVICE FOR TAKING OUT CONTENTS

[76] Inventor: Hirosi Kondo, No. 30-4, Hanazono-cho, Nagasaki, Nagasaki, Japan

[22] Filed: Aug. 16, 1974

[21] Appl. No.: 498,227

[52] U.S. Cl. ..... 222/384

[51] Int. Cl.[2] ..... B67D 5/54

[58] Field of Search ..... 222/373, 383, 384, 400.5, 222/401, 402, 321; 239/322, 331

[56] References Cited

UNITED STATES PATENTS

| | | | |
|---|---|---|---|
| 3,764,046 | 10/1973 | Riccio | 222/193 |
| 3,860,150 | 1/1975 | Maier | 222/193 |

*Primary Examiner*—Stanley H. Tollberg

*Attorney, Agent, or Firm*—Wenderoth, Lind & Ponack

[57] ABSTRACT

A dispenser device for use in dispensing liquid contents in a pressurized state from a container, compressed air obtained by pushing a dispenser head being utilized as a propellant for the liquid contents.

In this dispenser device, the compressed air used as a propellant is adapted to act upon the liquid contents without contacting the liquid thereby protecting the liquid contents from air contamination, quality deterioration and the like. Moreover, this dispenser device has a simple construction and since it contains no propellant it is non-explosive.

4 Claims, 5 Drawing Figures

DISPENSER DEVICE FOR TAKING OUT CONTENTS

This invention relates to a dispenser device for dispensing the contents of a container, and more particularly to an isolation type dispenser device in which compressed air obtained by pressing the dispenser head downwardly is utilized as a propellant, said compressed air being adapted to act upon the contents in the container without actually contacting the contents.

Foodstuff, pharmaceuticals, cosmetics and the like are usually packed in airtight containers isolated from the open air or a propellant when a sterilized condition is necessitated or contamination or deterioration through contact with open air or a propellant must be avoided.

As a means of dispensation of the foregoing contents from the containers as desired, cans of a "Sepro" type as commercially known have been used heretofore in which elastic bellows, collapsible bags or pistons were adapted to be driven by high pressure liquefied or gaseous propellants confined in the containers, such as fluoridized hydrocarbon derivatives, liquefied petroleum gas, and the like.

However, since the Sepro type can is constantly subjected to internal pressure, said can is not free from the drawback of leakage of the propellant through the sealed portions thereof. Particularly when a synthetic resin container is used, the dispensation efficiency is liable to be reduced as a result of permeation of the confined gas through the container wall in the course of storage for a long period of time, since such a container is gas permeable to some extent.

The conventional container has a further disadvantage in that the propellant filling process requires expensive equipment and advanced technical skill resulting in high cost of production. Said container involves a still further disadvantage in that a heat sterlizing treatment given to foodstuffs, pharmaceuticals and the like is attended by a risk of the internal pressure of the can being raised by the heating of the propellant. On the other hand, when stored in a refrigerator, the can is deprived of the dispensing efficiency due to a reduction of the internal pressure.

Therefore, a device making it possible to dispense the contents simply by pressing the dispenser head without using any propellant of the conventional type has long been waited for by the manufacturers concerned.

This invention relates to an isolation type dispenser device in which compressed air obtained by pressing the dispenser head is utilized as a propellant for the contents, the compressed air being adapted to act upon the contents without contacting the contents.

A first object of this invention is to provide a dispenser device in which compressed air obtained by pressing the dispenser head is utilized as a propellant for dispensing the contents thereby avoiding risk of leakage of the contents or propellant due to maintenance of the internal pressure of the container for a long period of time.

A second object of this invention is to provide an isolation type dispenser device in which compressed air used as a pressure propellant is isolated from the contents stored in the container thereby making it possible to protect the contents from contamination and quality deterioration caused by the air.

A third object of this invention is to provide a dispenser device making it possible to obtain a dispensed product in the form of a uniform and fine mist by employing a spring member adapted to apply further pressure to the contents so as to prevent loss of pressure of the compressed air resulting from a reduction in the volume of the contents during the dispensing process.

A fourth object of this invention is to provide a dispenser device having a simple construction making it possible to dispense the contents simple by pressing the dispenser head by hand.

These and other objects are accomplished by the parts, improvements, combinations and arrangements comprising this invention, preferred embodiments of which are shown by way of example in the annexed drawings and herein described in detail. In the drawings.

Figure 1:
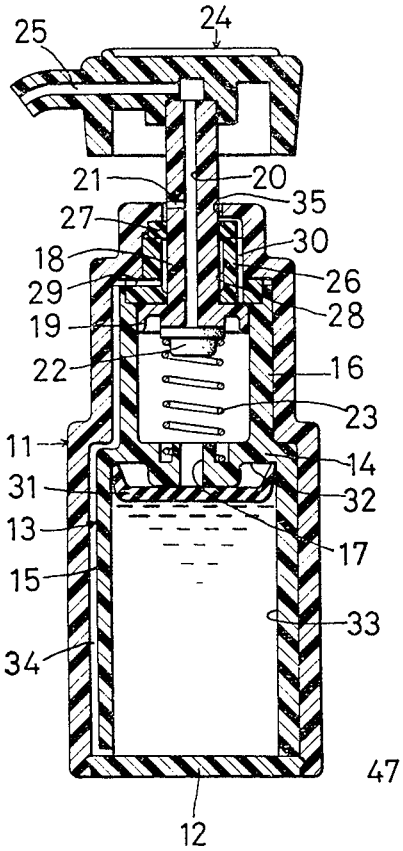
FIG. 1 is a vertical, sectional view of a first embodiment of this invention showing the parts in positions before pressure is applied to the dispenser head.
Figure 2:
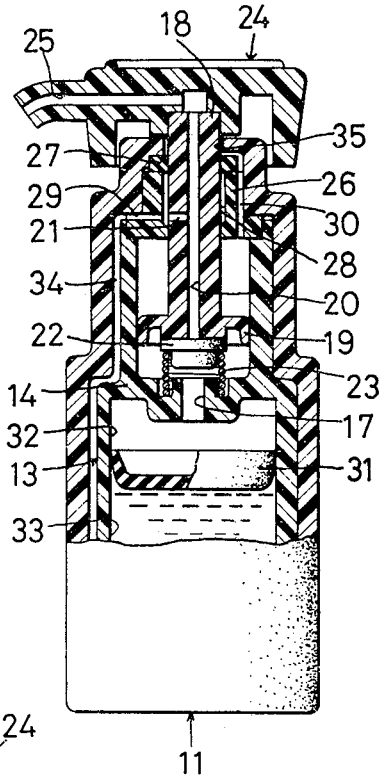
FIG. 2 is a vertical, sectional view of the same showing the parts in positions after the dispenser head has been pressed.

In the first embodiment shown in FIGS. 1 and 2, numeral 11 designates a container made of a synthetic resin or the like, said container being of a size which can be held in one hand and having an intermediate and an upper portion with successively diminishing diameters, the open bottom of said container 11 being closed by a bottom member 12 attached securely thereto.

The bottom member 12 should not be easily detachable since the interior of the container 11 will be under internal pressure, and moreover said bottom member 12 is airtightly attached so as to prevent the occurrence of leakage.

The numeral 13 designates an interior member with in the container 11, the outer shape of said member 13 being so formed that it will snugly fit within the container 11.

The interior member 13 comprises in combination a partition 14 extending horizontally in the middle portion thereof, a cylinder 15 in the lower portion thereof the lower end of which is adapted to abut the bottom member 12, and a valve casing 16 in the upper portion thereof having a smaller diameter than that of said cylinder 15.

The interior of the cylinder 15 and that of the valve casing 16 are adapted to communicate with each other through a hole 17 provided in the center of the partition 14, an elevatable piston rod 18 being fitted into an opening 35 provided in the upper end wall of the container 11.

On the lower end of the piston rod 18 is a piston 19 airtightly slidable along the inner peripheral wall of the valve casing 16, the piston rod 18 being provided with a bore 20 extending through said piston rod 18 from the upper end to the lower end thereof and a transverse orifice 21 the length of and through the outer periphery of said piston rod 18.

Within the valve casing 16 and at the lower end of the piston rod 18 at which the bore 20 opens is provided a check valve 22 for opening and closing the lower end of said bore 20, between the check valve 22 and the partition 14 is provided a spring 23 not only for urging said check valve 22 into pressure contact with the piston rod 22 thereby closing the bore 20 but also for imparting upward force on the piston rod 18 through said check valve 22.

To the upper end of the piston rod 18 projecting from the container 11 is secured a dispenser head 24 serving also as a presser for the piston rod 18, a spray duct 25 of the dispenser head 24 being in communication with the bore 20.

Within the upper end of the container 11 and in the upper portion of the valve casing 16 are a bush 26 externally fitted on the piston rod 18 and packing 27 above said bushing 26.

The bushing 26 is held in position sandwiched in between the upper end of the valve casing 16 and the container 11, the inner periphery of the bushing 26 being larger in diameter than the piston rod 18 so that a space 28 is formed between the inner periphery of the bushing 26 and the outer periphery of the piston rod 18, the lower portion of the inner periphery of the bushing 26 having a smaller diameter so as to slide airtightly on the exterior periphery of the piston rod 18.

The bushing 26 is provided with a transverse passage 29 communicating with the space 28 and opening at the outer periphery of the bushing so as to admit therethrough the substance to be dispensed, the bushing 26 also being provided with an air duct 30 in the form of a groove extending longitudinally along the outer periphery of said bushing 26 for placing the upper chamber of the valve casing 16 in communication with the open air through the opening 35 and for preventing the occurrence of vacuum during the descent of the piston 19.

The packing 27 is held in position sandwiched between the upper end of the bushing 26 and the upper end wall of the container 11, the inner periphery of the packing 27 being airtightly slidable on the outer periphery of the piston rod 18, the outer periphery of said packing 27 being positioned not to obstruct the communication of the air duct 20 with the open air.

Furthermore, within the cylinder 15 is an isolation member 31 for dividing the interior of said cylinder 15 into two chambers. It is desirable that the isolation member 31 be made of a synthetic resin or a similar soft material so that the outer periphery of said isolation member 31 is brought into pressure contact with the inner periphery of the cylinder 15 is airtightly slidable upwardly and downwardly therealong.

In this embodiment, the isolation member 31 is shown in the form of a piston, but the piston may be replaced with a diaphragm, bellows, or the like, so as to obtain the same effect.

Within the cylinder 15, the upper chamber 32 defined by the isolation member 31 is a compartment in which compressed air generated as a pressure propellant in the valve casing 16 operates, the lower chamber 33 being a compartment in which liquefied substance, such as foodstuffs, pharmaceuticals, cosmetics and the like, is to be stored.

Between the inner periphery of the container 11 and the outer periphery of the interior member 13 is provided a passage 34 communicating at its upper end with the passage 29 of the bushing 26 and at its lower end with the lower chamber 33 at the lower end of the cylinder 15 thereby permitting the pressurized contents to flow into the spray duct 25 of the dispenser head 24.

The first embodiment of this invention comprises the construction as described hereinbefore, and the contents stored in the container are dispensed during the operation as described hereinafter.

If the dispenser head 24 is pressed to the position as shown in FIG. 2 from that of FIG. 1 in which the dispenser head 24 is elevated, the air confined within the valve casing 16 is compressed by the descent of the piston 19.

The compressed air flows into the upper chamber 32 within the cylinder 15 through the hole 17 thereby pressing the isolation member 31 in the direction of the applied pressure with the result that the contents are placed under pressure through the isolation member 31.

When the orifice 21 of the piston rod 18 moves down far enough to communicate with space 28 within the bushing during the downward pressing of the dispenser head 24, the bore 20 is caused to communicate with the passage 34, whereby the contents under pressure within the lower chamber 33 are dispensed outwardly through the spray duct 25 from the bore 20 by way of the passages 34 and 29, the space 28 and the orifice 21.

The dispensing stops when the dispenser head 24 reaches its lowest limit with the utmost contraction of the spring 23, and the air is decompressed during the descent of the isolation member 31 as a result of dispensing of the contents.

Furthermore, when the piston 19 is lowered within the valve casing 16, a vacuum is theoretically created in the vacant space produced in the upper part of the casing 16. Since this is undesirable, said vacant space communicates constantly with the open air through the air duct 30 and the opening 35 thereby preventing the occurrence of the vacuum.

If pressure is removed from the dispenser head 24 on completion of the dispensing, the piston rod 18 is restored to its elevated position as shown in FIG. 1 pressed upwardly by the constricted spring 23 through the check valve 22.

Then, a vacuum is naturally created within the valve casing 16 and the upper chamber 32 of the cylinder 15 as a result of the ascent of the piston 19, the check valve 22 being separated from the lower end of the piston rod 18 against the spring 23 by the suction caused by the creation of vacuum thereby causing the bore 20 and the interior of the valve casing 16 to communicate with each other, with the result that the air flows into the valve casing 16 through the bore 20, the orifice 21 and the spray duct 25 thereby enabling not only to preventing the occurrence of vacuum but also to fill the valve casing 16 with air so as to be ready for the next dispensing operation.

After the dispensing, undispensed substance sometimes remains in the orifice 21, the bore 20 and the spray duct 25. This device, however, makes it possible to direct such undispensed substance into the valve casing 16 when air is supplied to the valve casing 16 through the orifice 21 and the spray duct 25, as a result of which this device makes it possible to prevent deteriorated undispensed substance from mixing with the subsequent portion to be dispensed even where the contents are liable to dry out or deteriorate.

Figure 3:
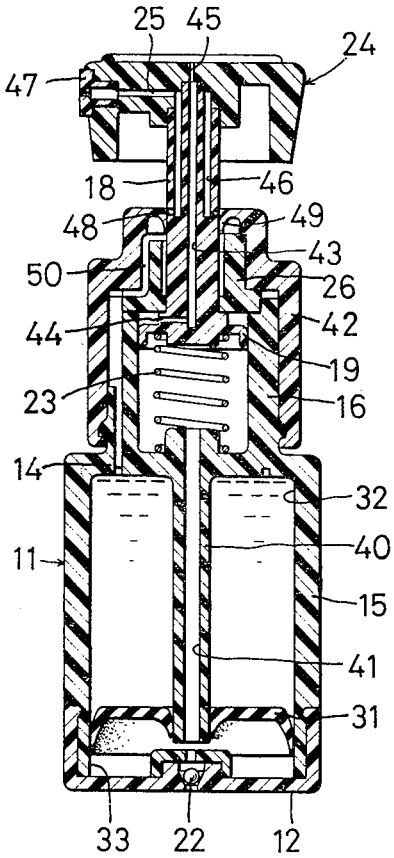
FIG. 3 is a vertical, sectional view of a second embodiment of this invention showing the parts in positions before pressure is applied to the dispenser head.

Referring now to the second embodiment shown in FIG. 3, the description will be omitted with regard to the parts having the same construction and function, as those shown in FIGS. 1 and 2 simply by affixing the identical reference numbers thereto.

In the second embodiment shown in FIG. 3, the lower half of the container 11 directly constitutes a cylinder 15, the portion above the partition 14 constituting a valve casing 16.

In the center of the bottom member is provided a check valve permitting influx of air into the cylinder 15 while precluding outflow thereof, a pipe 40 extending axially through the cylinder 15 with its upper end communicating with the interior of the valve casing 16, and the lower end being located in the lower end portion of the cylinder 15, the interior of said pipe 40 constituting an air duct 41.

Within the cylinder 15 is an isolation member 31 airtightly slidable on the outer periphery of the pipe 40, the lower chamber 33 being in communication with the air duct 41, the upper chamber constituting a space for storage of the contents.

On the valve casing 16 is mounted a cap member 42, the bushing 26 being held in position between said member 42 and the upper end of the valve casing 16.

An air duct 43 is bored axially from the upper end of the piston rod 18 and has its lower end closed, a transverse hole 44 being bored in the piston rod 18 in a position adjacent to the upper part of the piston 19 thereby placing the air duct 43 and the upper chamber of the valve casing 16 in communication with each other, a small hole 45 being bored in the dispenser head 24 for communication between the air duct 43 and the outside thereby preventing the occurrence of a vacuum above the piston 19.

An annular bore 46 is formed in piston rod 18 for the passage of the substance to be dispensed therethrough around the air duct 43 and above the middle portion of the piston rod 18, the upper end of bore 46 being in communication with the spray duct 25 of the dispenser head 24 provided with a nozzle 47, and an orifice 48 extending out of the piston rod from the bore 46 at the middle part of the piston rod 18.

The upper end opening of the cap member 42 constitutes a packing member 49 slidable on the outer periphery of the piston rod 18, a hole 50 for the passage of the substance to be dispensed therethrough being provided between the valve casing 16 and the cap member 42.

It must be noted that, in the second embodiment, the replenishment of air to the inside of the valve casing 16 and the dispensing of the contents are conducted through independent channels with the result that the residual undispensed substance remaining in the bore 46 and the spray duct 25 is not directed out of bore 46. Therefore, a construction for preventing the occurrence of vacuum above and below the piston 19 as shown in FIG. 1 is desirable where a substance to be dispensed is easy to dry or in case mixture of undispensed substance with the substance for the subsequent dispensing must be avoided.

In the case of the second embodiment of the dispenser device, if the dispenser head 24 is pressed in from the position as shown in FIG. 3, the air within the valve casing 16 is compressed by the descent of the piston 19, the check valve 22 being airtightly closed, thus the compressed air flowing through air duct 41 pressing the isolation member 31 upwardly, whereby the contents are placed under pressure.

When the orifice 48 opens into the cap member 42 so as to communicate with the hole 50, the pressurized contents are dispensed outwardly through the hole 50 and the spray duct 25.

If the pressure is removed from the dispenser head 24 after dispensing, the piston 19 and the piston rod 18 are elevated, the interior of the valve casing 16 being replenished with air through the opened check valve 22 if vacuum is created therein so as to be ready for the subsequent dispensing.

As a means of replenishing the interior of the valve casing 16 with air, the check valve 22 is built within the valve casing 16 in the first embodiment and in the bottom member 12 in the second embodiment respectively. However, the same effect is obtainable without the check valve as described hereinafter.

An alternative is to impart suitable resilience to the piston 19 so that its outer periphery will be separated from the inner periphery of the valve casing 16 when vacuum is created within the valve casing 16. Thus, air can be supplied through the hole 20 and the spray duct 25 in the first embodiment, and through the small hole 45 and the passage 43 in the second embodiment, respectively.

Furthermore, in the first and the second embodiments, if the orifices 21 and 48 are provided further upwardly on the piston rod 18, dispensing of the contents can be effected as soon as the compressed air is put under predetermined pressure thereby making it possible to prevent the occurrence of dripping due to insufficient pressure in the initial stage of dispensing.

Figure 4:
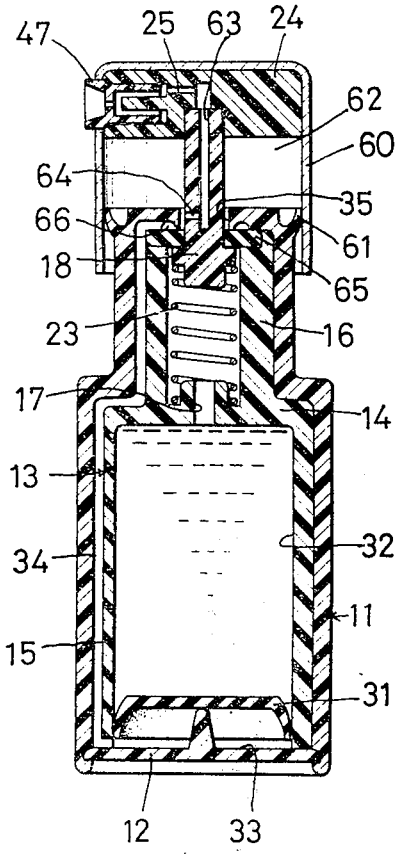
FIG. 4 is a vertical, sectional view similar to FIGS. 1 and 3 of a third embodiment of this invention.

Referring now to the third embodiment shown in FIG. 4, description will be omitted with regard to the parts having the same construction and function as those shown in FIGS. 1 and 2 by affixing the identical reference numerals thereto.

The third embodiment has a construction in which compressed air is produced between the dispenser head 24 and the container 11.

On the lower part of the dispenser head 24 is provided an annular peripheral wall 60 having an open bottom and externally fitted onto the upper end portion of the container 11, a resilient piece 61 being continuously formed on the upper end outer periphery of the container 11 so as to be airtightly and resiliently slidable on the inner periphery of the peripheral wall 60, a pressure chamber 62 thus being provided within the peripheral wall 60.

A bore 63 communicating at its upper end with the nozzle 47 of the dispenser head 24 and closed at its lower end is provided through the piston rod 18, an orifice 64 communicating with said passage 63 being provided the length of the piston rod 18.

A packing 65 in the upper part within the container 11 is held in position by the upper end of the valve casing 16. The interior periphery of the packing 65 is not only slidable airtightly and resiliently on the outer periphery of the piston rod 18 but also ordinarily overlaps the inner periphery of the upper end wall of the container 11.

On the inner periphery of the upper end wall of the container 11 is an annular groove 66 closed by the packing 65, the groove 66 being in communication with the lower chamber 33 within the cylinder 15 by the passage 34 provided between the container 11 and the cylinder 15.

In the third embodiment, the upper chamber 32 divided by the isolation member 31 constitutes the space for storage of the contents, the interior of the valve casing 16 constituting a passage for the flow of the substance to be dispensed.

If the dispenser head 24 is pressed in from the position as shown in FIG. 4, compressed air is created within the pressure chamber 62 as a result of the descent of the dispenser head 24 and the airtightness of the resilient piece 61.

The orifice 64 is initially closed by the packing 65, the compressed air acting upon the upper face on the side of the inner periphery of the packing 65 from the opening 35 as the pressure within the pressure chamber 62 is raised by the force applied to the dispenser head 24, whereby the packing 65 is separated from the upper end wall of the container 11 with its inner periphery curved downwardly thereby opening the groove 66 so as to communicate with the pressure chamber 62, with the result that the compressed air flows into the lower chamber 33 of the cylinder 15 through the passage 34 thereby pressing the isolation member 31 upwardly, the contents being placed under pressure and the piston rod 18 starting to move into the valve casing 16.

When the orifice 64 communicates with the interior of the valve casing 16 during downward movement of rod 18, the contents under pressure are dispensed outwardly from the nozzle through the orifice 64 and the bore hole 63.

If the pressure is removed from the dispenser head 24 after dispensing, the dispenser head 24 and the piston rod 18 are elevated to their initial positions by the upward force of the spring 23. Although a state of vacuum is created in the pressure chamber 62, the resilient piece 61 is detached from the peripheral wall due to negative pressure within said pressure chamber 62 thereby replenishing said chamber 62 with air so as to be ready for the subsequent dispensing.

Figure 5:
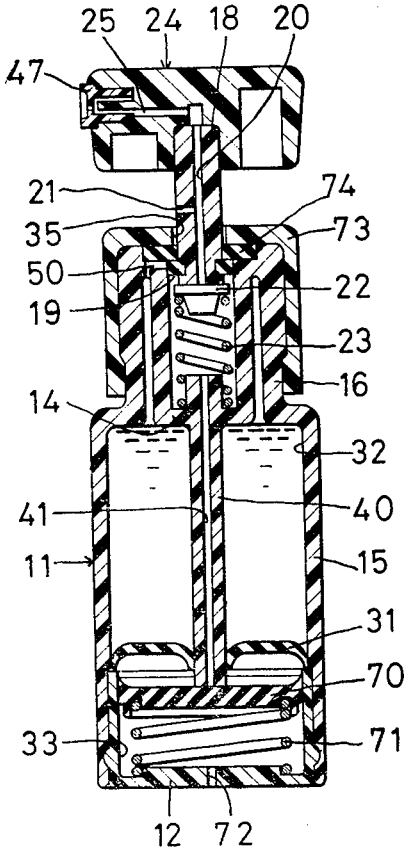
FIG. 5 is a vertical, sectional view similar to FIGS. 1, 3 and 4 of a fourth embodiment.

Referring now to the fourth embodiment shown in FIG. 5, description will be omitted with regard to the parts having the same construction and function as those shown in FIGS. 1 to 4 by affixing the identical reference numerals thereto.

The fourth embodiment is a dispenser device in which reduction of the pressure of the compressed air resulting from dispensing is compensated for by means of a spring member thereby making it possible to maintain the spray pattern without variation throughout the dispensing.

Within the lower chamber 33 of the cylinder 15 partitioned off by the isolation member 31 is a piston 70 the outer periphery of which is airtightly slidable on the inner periphery of the cylinder 15 similarly to the second embodiment shown in FIG. 3.

The inner periphery of the lower chamber 33 of the cylinder 15 has a cup-shaped bottom member 12 closing the lower end opening of the cylinder 15. The piston 70 is slidable within the bottom member 12.

Within the bottom member 12 is provided a spring 71 for constantly urging the piston 70 upwardly. When dispensing is not effected, the piston 70 is at its highest limit abutting the lower end of the pipe 40.

Through the bottom of the bottom member 12 is a small hole 72 placing the interior in communication with the open air so as not to impede the vertical reciprocation of the piston 70.

The container 11 comprises the valve casing 16 and the cylinder 15 integrally formed with each other, an independent cap member 73 being mounted on the outer periphery thereof, a hole 50 for the admission of the substance to be dispensed being formed in the valve casing 16.

The piston rod 18 inserted into the valve casing 16, the piston 19, the check valve 22 and the spring 23 within the valve casing 16 are the same construction as in the first embodiment shown in FIGS. 1 and 2.

A nozzle 47 is provided at the forward end of the spray duct 25 of the dispenser head 24 mounted on the upper end of the piston rod 18, a packing 74 externally fitted around the piston rod 18 being positioned between the upper end of the valve chamber 16 and the cap member 42.

In the foregoing fourth embodiment, if pressure is applied to the dispenser head 24 with the parts in the positions as shown in FIG. 5, the air within the valve casing 16 is compressed by the descent of the piston 19, the check valve 22 being airtightly closed, whereby the compressed air is conducted into the lower chamber 33 of the cylinder 15 through the air duct 41.

The compressed air admitted into the lower chamber 33 not only presses the piston 70 downwardly against the spring 71 but also presses the partition member 31 upwardly, whereby the contents within the upper chamber 32 are placed under pressure.

When the piston 18 is further pressed downwardly until it reaches its lowest limit, the orifice 21 communicates with the hole 50 thereby dispensing the pressurized contents outwardly through the hole 50 and the spray duct 25.

The contents begins to lose pressure resulting from a quantitative reduction of said contents as soon as the dispensing starts. However, the piston 70 is elevated by the simultaneous extension of the spring 71 so as to replenish the reduced pressure, whereby the dispensing is effected with a uniform spray pattern until the piston 70 abuts the pipe 40.

If the pressure is removed from the dispenser head 24 after dispensing, the piston 19 and the piston rod 18 are elevated, the check valve 22 within the valve casing 16 is opened thereby replenishing the valve casing 16 with air so as to be ready for the subsequent dispensing.

The fourth embodiment makes it possible to obtain a very fine mist by high pressure spray.

To be more precise, high pressure is obtainable by a comparatively slight pressure of the fingers by making the surface area of the piston 70 more than that of the piston 19. Therefore, compressed air of high pressure is obtainable by raising the pressure of the spring 71 thereby making it possible to create a very fine mist by means of high pressure spray.

What is claimed is:

1. An isolation type dispenser device comprising, in combination, a container having a cylinder therein and including a bottom member; an isolation member airtightly and slidably mounted within the cylinder and dividing the cylinder into a contents storage chamber and a propellant chamber; a piston rod slidable into the container, the piston rod having an axial passage and an orifice opening transversely therefrom, a dispenser head communicating with the passage and mounted on said piston rod; a spring within the container urging the piston rod upwardly; a pressure propellant generating means for creating compressed air by the descent of the dispenser head and the piston rod; a passage between the generating means and the propellant chamber within the cylinder for conducting compressed air thereto to act upon the isolation member; and a further passage between the contents storing chamber and the axial passage in said piston rod, whereby the contents in said contents storage chamber are forced under the pressure created by the generating means through the axial passage and the dispenser head to be dispensed.

2. An isolation type dispenser device as claimed in claim 1 in which the pressure propellant generating means comprises a valve casing communicating with the cylinder and a piston mounted on the lower end of the piston rod and airtightly slidable within the valve casing; said dispenser having an air duct between the upper part of the valve casing and the outside of the dispenser for preventing a vacuum in the upper part of the valve casing when the piston is lowered, the passage through the piston rod being open at its lower end through said piston so as to prevent a vacuum in the lower part of said valve casing when the piston is elevated, a check valve at the lower end of the axial passage through the piston rod, and a spring urging the check valve into pressure contact with said lower end.

3. An isolation type dispenser device as claimed in claim 1 in which the pressure propellant generating means comprises a valve casing communicating with the cylinder and a piston mounted on the lower end of the piston rod and airtightly slidable within the valve casing; said piston rod having therein an air duct and a transverse hole therefrom for causing said air duct to communicate with the upper part of said valve casing when said piston rod is moved into said valve casing, the dispenser head having a small hole therein between the air duct and the outside of the dispenser so as to prevent a vacuum in the upper part of said valve casing when the piston is lowered, a tubular member extending from the interior of the valve casing to within the pressure propellant chamber, a check valve in the bottom member for preventing the generation of a vacuum in the lower part of said valve casing when the piston is elevated.

4. An isolation type dispenser device as claimed in claim 1 in which the pressure propellant generating means comprises a peripheral wall depending from the dispenser head and fitted over the upper end of the container, and a resilient piece around the upper end periphery of the container and airtightly slidable on the inner periphery of said peripheral wall, said resilient piece being separated from the wall when the dispenser head moves upwardly for preventing a vacuum from being generated within the pressure propellant generating means, a resilient packing airtightly fitted externally around the piston rod between the orifice and the further passage, said packing having a portion which deflects under pressure of the compressed air for placing the orifice in communication with the further passage.

* * * * *